US012606996B2

(12) United States Patent
Gerner et al.

(10) Patent No.: US 12,606,996 B2
(45) Date of Patent: Apr. 21, 2026

(54) FAUCET WITH ORIENTATION-BASED FLOW RATE CONTROL

(71) Applicants: Randolph Henry Gerner, New York, NY (US); Ryan Christopher Tatzel, Babylon, NY (US)

(72) Inventors: Randolph Henry Gerner, New York, NY (US); Ryan Christopher Tatzel, Babylon, NY (US)

( * ) Notice: Subject to any disclaimer, the term of this patent is extended or adjusted under 35 U.S.C. 154(b) by 0 days.

(21) Appl. No.: 18/830,500

(22) Filed: Sep. 10, 2024

(65) Prior Publication Data

US 2025/0179779 A1 Jun. 5, 2025

Related U.S. Application Data

(60) Provisional application No. 63/604,586, filed on Nov. 30, 2023.

(51) Int. Cl.
*E03C 1/04* (2006.01)
*E03C 1/05* (2006.01)

(52) U.S. Cl.
CPC ..... *E03C 1/0404* (2013.01); *E03C 1/055* (2013.01)

(58) Field of Classification Search
CPC ..... E03C 1/0404; E03C 1/0405; E03C 1/055; E03C 2001/0414
See application file for complete search history.

(56) References Cited

U.S. PATENT DOCUMENTS 2,524,956 A 10/1950 Brunetti
2,635,006 A 4/1953 Richmond
2,878,059 A 3/1959 Limle
3,079,088 A 2/1963 Lawrence et al.
3,133,701 A 5/1964 Mcclenahan
3,265,307 A 8/1966 Slater, Jr.
3,325,101 A 6/1967 Cuschera
3,462,080 A 8/1969 Howard et al.
3,512,711 A 5/1970 Abbott
4,552,306 A 11/1985 Litwak et al.
(Continued)

FOREIGN PATENT DOCUMENTS

DE 202005020483 U1 5/2006
DE 202018100019 U1 * 1/2018 ..... E03C 1/0405
(Continued)

OTHER PUBLICATIONS

Translation of DEDE202018100019 (Year: 2018).*

*Primary Examiner* — Patrick C Williams
(74) *Attorney, Agent, or Firm* — MASCHOFF BRENNAN; Andrew A. Noble

(57) ABSTRACT

A faucet is disclosed comprising a main body having a lower inlet operative to receive a waterway and an upper outlet. A spout has a first portion connected to the upper outlet of the main body and operative to receive water flowing from the waterway, and a second portion extending along a plane outward from the main body and operative to allow water from the waterway to flow therethrough. A spout tip connected to the second portion of the spout provides an exit for water flowing from the waterway. A flow rate controller is connected to at least one of the spout or the spout tip to provide for maintaining or adjusting a flow rate of water flowing through the exit as at least one of the spout or the spout tip pivots in response to a user input.

24 Claims, 8 Drawing Sheets

(56) References Cited

U.S. PATENT DOCUMENTS

| | | | | |
|---|---|---|---|---|
| 4,778,108 | A | 10/1988 | Richards | |
| 4,991,775 | A | 2/1991 | Huber et al. | |
| 5,775,587 | A | 7/1998 | Davis | |
| 6,805,151 | B1 | 10/2004 | Chang | |
| 6,808,123 | B2 | 10/2004 | Chiu et al. | |
| 7,090,144 | B2 | 8/2006 | Gross et al. | |
| 7,552,747 | B1 * | 6/2009 | Sargsyan | E03C 1/0404 4/601 |
| 8,322,377 | B2 | 12/2012 | Di Nunzio | |
| 9,328,486 | B2 | 5/2016 | Chong et al. | |
| 9,487,935 | B2 | 11/2016 | Waddell | |
| 10,378,190 | B2 | 8/2019 | Waddell | |
| 11,242,675 | B2 | 2/2022 | Chung | |
| 11,408,543 | B2 | 8/2022 | Chung | |
| 11,703,156 | B2 | 7/2023 | Chung et al. | |
| 2003/0132306 | A1 | 7/2003 | Chiu et al. | |
| 2006/0101570 | A1 | 5/2006 | Kunkel | |
| 2007/0251590 | A1 | 11/2007 | Weinstein | |
| 2008/0277927 | A1 * | 11/2008 | Mueller | F16L 27/0808 285/272 |
| 2011/0233296 | A1 | 9/2011 | Stude | |
| 2011/0290901 | A1 | 12/2011 | Dittman, III | |
| 2014/0367482 | A1 * | 12/2014 | Cacka | B05B 1/3026 4/601 |
| 2019/0388914 | A1 * | 12/2019 | Yang | B05B 1/3006 |
| 2020/0071917 | A1 * | 3/2020 | Tentler | E03C 1/0401 |
| 2020/0385963 | A1 * | 12/2020 | Song | E03C 1/0404 |

FOREIGN PATENT DOCUMENTS

| | | | |
|---|---|---|---|
| EP | 0787863 | A1 | 8/1997 |
| KR | 0138162 | Y1 | 4/1999 |

* cited by examiner

FAUCET WITH ORIENTATION-BASED FLOW RATE CONTROL

CROSS-REFERENCE TO RELATED APPLICATIONS

This application claims the benefit of U.S. Provisional Patent Application No. 63/604,586 filed Nov. 30, 2023. The entire contents of that application is hereby incorporated herein by reference.

FIELD OF THE TECHNOLOGY

This disclosure relates generally to faucets and, more particularly to an assembly for flow rate control of a faucet.

BACKGROUND

Many faucets designed for site-specific use cases, e.g., kitchen, bathroom/lavatory, laundry, garage/industrial work area, etc. are oftentimes employed in a variety of applications. For example, a kitchen faucet may be used for both food preparation applications and to wash dishes. A garage/work area faucet may be used for applying pressurized water both within a basin area (e.g., to clean tools or parts) and outside of a basin area (e.g., to clean a shop floor). Particularly, faucets designed for bathroom/lavatory use are often employed in wide-ranging applications. Bathroom/lavatory faucets may be used for typical sanitary tasks (e.g., washing hands), dental hygiene (e.g., rinsing after brushing teeth or using mouth wash), shaving, washing hair, as a source of drinking water (e.g., for taking medication), etc. In addition, bathroom/lavatory faucets also may need to function as versatile cleaning apparatuses, e.g., for a sink basin after daily or occasional tasks are performed.

In recent years, faucet designs that take multiple use cases into account have proliferated, particularly for kitchen use cases. For example, there are faucet designs that include detachable spouts having flexible hoses that provide freedom of motion for a user to direct water to a target spray area. Various other faucet designs employ multiple water pressure modes, e.g., a high-pressure mode ideal for washing dishes and a spray mode ideal for rinsing dishes, the sink basin, or outside areas in the vicinity of the sink basin. However, faucet designs that can be adapted suitably to use cases that often involve wide-ranging applications, e.g., bathroom/lavatory use cases, remain a challenge.

SUMMARY

The embodiments described herein allow for a faucet suitable for multiple use cases based on a novel mechanism for orientation-based flow rate control.

In one embodiment, a faucet comprises a main body having a lower inlet operative to receive a waterway and an outlet. The faucet further comprises a spout having a first portion connected to the upper outlet of the main body and operative to receive water flowing from the waterway, and a second portion extending along a plane outward from the main body and operative to allow water from the waterway to flow therethrough, where the spout is operative to pivot around a first axis in response to a first user input. For example, the spout may be operative to pivot with at least 120 degrees of freedom around the first axis, or with at least 180 degrees of freedom around the first axis. The second portion of the spout may extend along a plane substantially perpendicular to the main body, and the first axis may be substantially co-axial with, or substantially parallel to, the main body. The faucet further comprises a spout tip connected to the second portion of the spout, the spout tip providing an exit for water flowing from the waterway, where the spout tip is operative to pivot around a second axis in response to a second user input. For example, the spout tip may be operative to rotate with at least 180 degrees of freedom around the second axis, or with 360 degrees of freedom around the second axis. The second axis may be substantially perpendicular to a center axis of the main body. A flow rate controller is connected to at least one of the spout or spout tip and operative to provide for maintaining or adjusting a flow rate of water flowing through the exit in response to at least one of the spout pivoting around the first axis or the spout tip pivoting around the second axis. The flow rate controller may comprise at least one adjustable element connected to an inner portion of at least one of the spout or spout tip to provide for adjusting the flow rate of water exiting through the outlet. The adjustable element may define a cross-sectional area for allowing a flow of water through the spout tip such that the flow rate of water flowing through the exit changes in accordance with a movement of the adjustable element.

In some embodiments, the flow rate controller may comprise a valve connected to an inner portion of at least one of the spout or spout tip. The valve may comprise a first valve element movable in accordance with at least one of the spout pivoting around the first axis or the spout tip pivoting around the second axis, and a second valve element operative to remain in a fixed position with respect to the first valve element, where the first valve element may be operative to change orientation with respect to the second valve element to provide for adjusting the flow rate of water exiting through the outlet. In some embodiments, the first valve element may be operative to rotate with respect to the second valve element to provide for an opening having a variable cross-sectional area for water flowing from the waterway.

In some embodiments, the flow rate controller may comprise a control portion operably coupled to the waterway and movable from a first position for providing a first flow rate of water, to a second position for providing a second flow rate of water. The control portion may be movable to the first position for providing the first flow rate of water when the spout tip is oriented between −90 and 90 degrees with respect to a plane parallel to the main body, and to the second position for providing the second flow rate of water when the when the spout tip is oriented between −90 to −180 degrees or 90 to 180 degrees with respect to the plane parallel to the main body. For example, the second flow rate may be less than the first flow rate.

In some embodiments, the flow rate controller may comprise an aerator connected to the spout tip.

In some embodiments, the faucet may further comprise a second flow rate controller operative to provide for adjusting the flow rate of water flowing through the exit in response to a third user input. The second flow rate controller may comprise a temperature controller operative to provide temperature control for water flowing from the waterway. For example, the second flow rate controller may comprise at least one of a faucet lever or spout assembly connected to at least one of the spout, the spout tip, or the main body.

In some embodiments, the flow rate controller may be further operative to provide for adjusting a target spray area of water flowing through the exit in response to a fourth user input.

In some embodiments, the flow rate controller may comprise a flow rate constrictor operative to maintain the flow rate of water flowing through the exit at or below a threshold in response to at least one of the spout pivoting around the first axis or the spout tip pivoting around the second axis.

In some embodiments, the faucet further comprises a mode controller operative to receive, at a user interface, at least one of the first user input or the second user input; and cause the second portion of the spout to pivot around the first axis in response to the first user input or the spout tip to pivot around the second axis in response to the second user input.

The embodiments further comprise a method of manufacturing a faucet with orientation-based flow rate control.

BRIEF DESCRIPTION OF THE DRAWINGS

The present application can be best understood by reference to the embodiments described below taken in conjunction with the accompanying drawing figures, in which like parts may be referred to by like numerals.

DETAILED DESCRIPTION

Figure 1A:
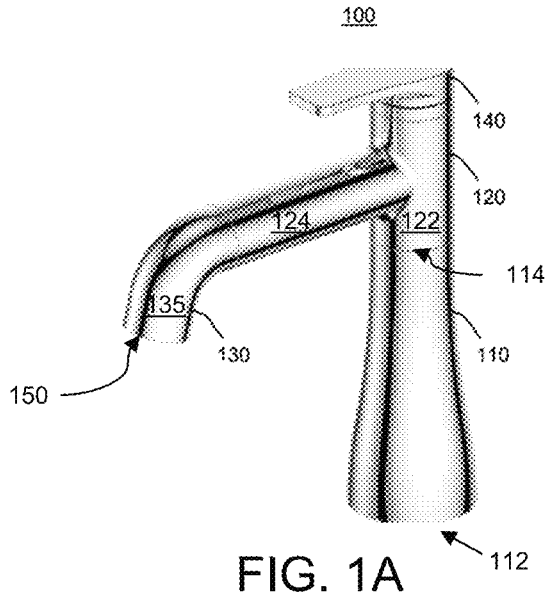
FIG. 1A is a perspective view of a faucet with orientation-based flow rate control in accordance with various embodiments.

To provide a more thorough understanding of various embodiments of the present invention, the following description sets forth numerous specific details, such as specific configurations, parameters, examples, and the like. It should be recognized, however, that such description is not intended as a limitation on the scope of the present invention but is intended to provide a better description of the exemplary embodiments.

Throughout the specification and claims, the following terms take the meanings explicitly associated herein, unless the context clearly dictates otherwise:

The phrase "in one embodiment" as used herein does not necessarily refer to the same embodiment, though it may. Thus, as described below, various embodiments of the disclosure may be readily combined, without departing from the scope or spirit of the invention.

As used herein, the term "or" is an inclusive "or" operator and is equivalent to the term "and/or," unless the context clearly dictates otherwise.

The term "based on" is not exclusive and allows for being based on additional factors not described unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Although the following description uses terms "first," "second," etc. to describe various elements, these elements should not be limited by the terms. These terms are only used to distinguish one element from another. For example, a first pulse generating circuitry could be termed a second pulse generating circuitry and, similarly, a second pulse generating circuitry could be termed a first pulse generating circuitry, without departing from the scope of the various described examples. The first pulse generating circuitry and the second pulse generating circuitry can both be pulse generating circuitry and, in some cases, can be separate and different pulse generating circuitry.

In addition, throughout the specification, the meaning of "a", "an", and "the" includes plural references, and the meaning of "in" includes "in" and "on".

Although some of the various embodiments presented herein constitute a single combination of inventive elements, it should be appreciated that the inventive subject matter is considered to include all possible combinations of the disclosed elements. As such, if one embodiment comprises elements A, B, and C, and another embodiment comprises elements B and D, then the inventive subject matter is also considered to include other remaining combinations of A, B, C, or D, even if not explicitly discussed herein. Further, the transitional term "comprising" means to have as parts or members, or to be those parts or members. As used herein, the transitional term "comprising" is inclusive or open-ended and does not exclude additional, unrecited elements or method steps.

As used in the description herein and throughout the claims that follow, when a system, engine, server, device, module, or other computing element is described as being configured to perform or execute functions on data in a memory, the meaning of "configured to" or "programmed to" is defined as one or more processors or cores of the computing element being programmed by a set of software instructions stored in the memory of the computing element to execute the set of functions on target data or data objects stored in the memory.

It should be noted that any language directed to a computer should be read to include any suitable combination of computing devices or network platforms, including servers, interfaces, systems, databases, agents, peers, engines, controllers, modules, or other types of computing devices operating individually or collectively. One should appreciate the computing devices comprise a processor configured to execute software instructions stored on a tangible, non-transitory computer readable storage medium (e.g., hard drive, FPGA, PLA, solid state drive, RAM, flash, ROM, or any other volatile or non-volatile storage devices). The software instructions configure or program the computing device to provide the roles, responsibilities, or other functionality as discussed below with respect to the disclosed apparatus.

While current multiple use case faucet designs can include several technologically mature innovations, there are downsides for some typical functions. Faucets optimized for some use cases can lead to less-than-ideal adaption to other use cases. For example, bathroom/lavatory faucets often employ designs that necessitate tradeoffs between typical and occasional use functions. In some scenarios, there are even tradeoffs between typical functions. For example, bathroom/lavatory faucets for a primary use case of washing hands may be optimized based on parameters for water flow rate (e.g., water pressure), target spray area, etc. But when used for drinking water (e.g., to rinse after brushing teeth or using mouth wash), the optimizations for the primary use case may require the user to contort themselves by positioning their mouth underneath the spout tip to catch some portion of water directed toward a spray area of a sink basin or use a secondary apparatus, such as a cup to capture the water. Further, the faucet optimized for the primary use case may require a user to use their hands to direct the flow of water in other use cases, e.g., to clean the sink basin. Even then, the adaptions the user employs (hands to direct water, cups to capture and redirect flow, etc.) may be severely lacking for their intended purposes, especially when compared to the optimizations employed for the primary use case.

Other faucet designs rely on separate or removeable spout attachments, e.g., an auxiliary hose adjacent to, or in-line with, a faucet spout. However, these designs oftentimes do not provide for a seamless user experience. For example, a removable spout attachment or extension may have a connection with a primary portion of the spout that becomes imprecise with repeated use over time due to wear. For example, the spout attachment may become offset from its original intended direction, e.g., along the plane of the primary portion of the spout, due to wear. Further, such removable spout attachments often include flexible waterways, e.g., a flexible hose, which can tangle, get stuck, or not retract fully when the removable spout attachment is reattached to the primary portion of the spout. In addition, current designs do not typically provide for automatically adjusting a water flow rate based on the orientation of a spout attachment. Thus, water flow rates are not automatically adjusted to account for different use cases. Rather, typical designs rely on the user to adjust water flow rates based on the usage context. Therefore, if the user is not mindful, an adjustment to the orientation of a spout or spout attachment can cause water to spray outside of an intended spray area. For example, water can shoot out of a sink basin and soak adjacent surfaces such as counter tops, floor surfaces, bathroom mirrors, etc.

A faucet employing orientation-based flow rate control as described herein allows for controlling a direction of water spray while automatically maintaining or adjusting water flow rate in accordance with a spout and/or spout tip orientation, such as an orientation in accordance with a particular use case. For example, a faucet as disclosed in the various embodiments may comprise a spout operative to be rotatable, e.g., with up to 180 degrees of freedom, around a first axis to range across a sink basin with water exiting a spout tip toward a spray area within the sink basin at a first flow rate. In addition, the faucet may comprise a spout tip operative to be rotatable, e.g., with up to 360 degrees of freedom, to direct the water exiting the spout tip upward (e.g., similar to a water fountain) for drinking at a second flow rate, or at a reduce angle (e.g., −45 to +45 degrees) to direct the water exiting the spout tip toward certain areas of the sink basin for cleaning at a third flow rate. Therefore, a faucet having orientation-based flow rate control in accordance with embodiments described herein can be optimized for multiple use cases including, e.g., washing (hands or other things), drinking water, and/or cleaning a sink basin.

Figure 1B:
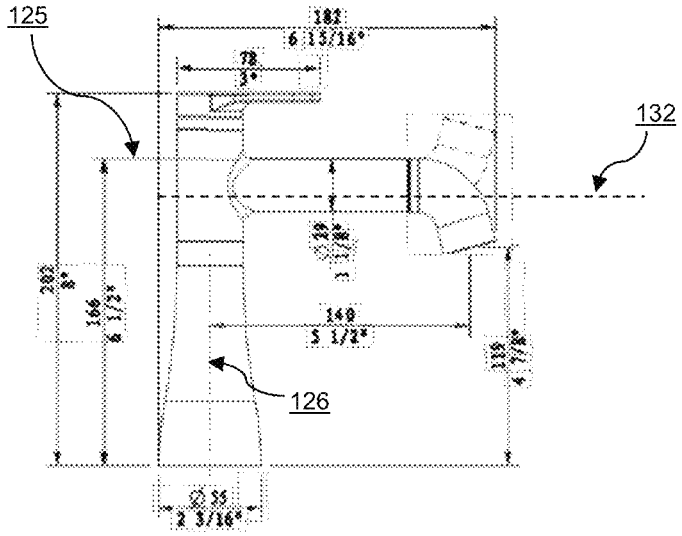
FIG. 1B is a schematic side view of a faucet with orientation-based flow rate control in accordance with various embodiments.

FIGS. 1A and 1B are perspective and schematic views of a faucet 100 with orientation-based flow rate control in accordance with various embodiments. Referring to both FIGS. 1A and 1B, faucet 100 may comprise a main body 110, a spout 120, a spout tip 130, a flow rate controller 135, and (optionally) a user interface 140.

The main body 110 includes a lower inlet 112 operative to receive a waterway (i.e., a water supply) and an upper outlet 114 (as shown in FIG. 1B). The main body 110 may have generally tubular housing (as shown in FIG. 1A), a box-shaped housing, or a housing of another shape. The lower inlet 112 of main body 110 may comprise a hub (not shown) including a hot-water inlet conduit fluidly coupled to a hot water supply, a cold-water inlet conduit fluidly coupled to a cold-water supply. For example, a mixing valve may be controlled by the user interface 140, e.g., a handle, to control a flow rate and temperature of water supplied by the hot and cold-water inlet conduits to the upper outlet 114. In some embodiments, as shown in FIGS. 1A and 1B, the lower inlet 112 may have an increased diameter to accommodate the hub.

The spout 120 is connected to the upper outlet 114 of main body 110 to receive water supplied by the waterway via the hot and cold-water inlets. For example, the spout 120 may include a first portion 122 connected to the upper outlet 114 of the main body 110 and operative to receive water flowing from the waterway and a second portion 124 extending along a plane 125 outward from the main body 110 and operative to allow water from the waterway to flow therethrough. For example, as shown in FIG. 1B, the second portion 124 of the spout 120 may extend along a plane substantially perpendicular to the main body 110. The spout 120 is operative to pivot around a first axis 126 in response to a first user input, e.g., in response to a user exerting a lateral force on the spout 120 that causes the spout 120 to pivot around the first axis 126. For example, as shown in FIG. 1B, the first axis 126 may be substantially co-axial with, or substantially parallel to, the main body 110.

Figure 2A:
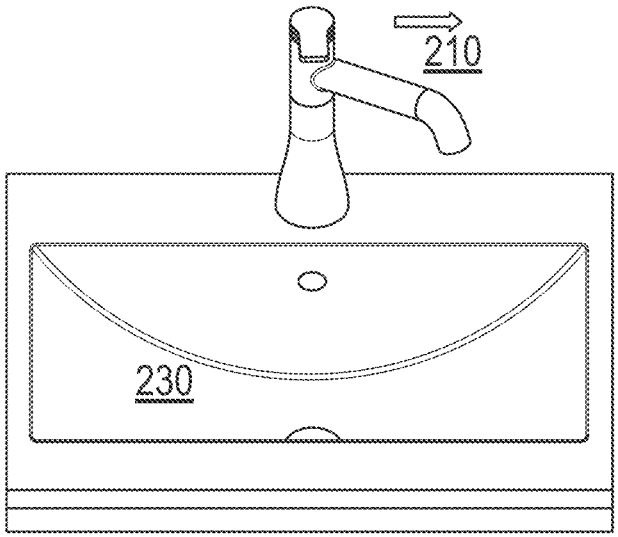
FIGS. 2A-2B are example perspective views showing operative aspects of a spout of a faucet with orientation-based flow rate control in accordance with various embodiments.
Figure 2B:
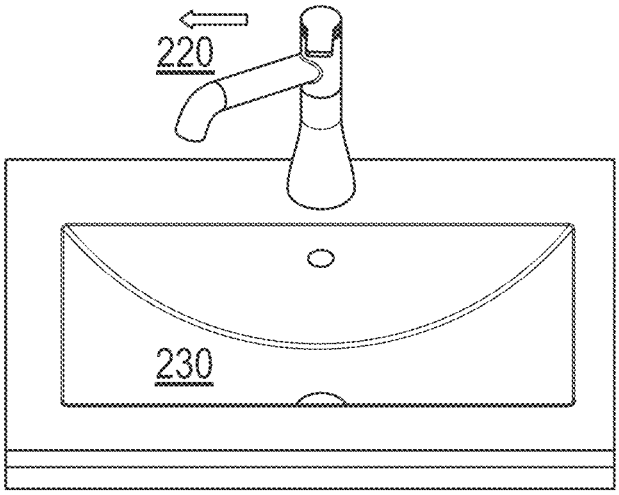
Figure 2C:
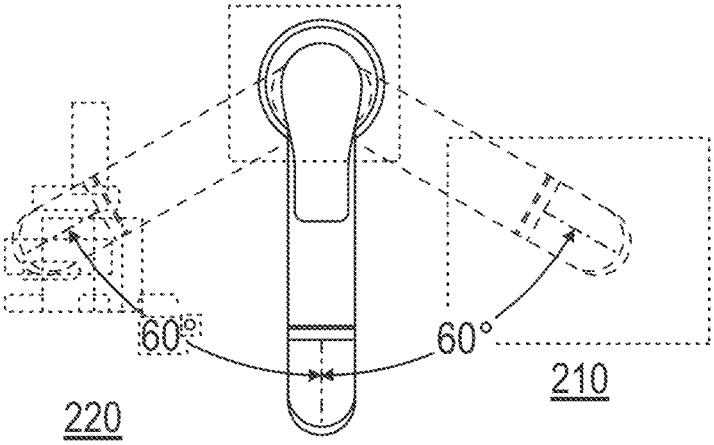
FIG. 2C is an example schematic view showing operative aspects of a spout of a faucet with orientation-based flow rate control in accordance with various embodiments.

FIGS. 2A-2C are perspective and schematic views showing operative aspects of a spout 120 of a faucet 100 with orientation-based flow rate control in accordance with various embodiments. Referring collectively to FIGS. 1A-1B and 2A-2C, the spout 100 may be operative to pivot around the first axis 126, e.g., in either a first direction 210, a second direction 220, or in both the first direction 210 and the second direction 220. For example, as shown in FIG. 2C, the spout 120 may be operative to pivot around the first axis 126 with at least 120 degrees of freedom (i.e., at least +/−60 degrees of freedom with respect to the first direction 210 and the second direction 220) around the first axis 126. In another example (not shown), the spout 120 may be operative to pivot around the first axis 126 with at least 180 degrees of freedom (i.e., at least +/−90 degrees in each of the first direction 210 and the second direction 220). For example, the degree of freedom with which the spout 120 is operative to pivot may be based on the area of a sink basin.

Referring back to FIGS. 1A and 1B, the spout tip 130 is connected to the second portion 124 of the spout 120. The spout tip 130 provides an exit 150 for water flowing from the waterway. As shown in FIG. 1B, the spout tip 130 is operative to pivot around a second axis 132 in response to a second user input, e.g., in response to a user exerting a force on the spout tip 130 that causes the spout tip 130 to pivot around the second axis 132. For example, as shown in FIG. 1B, the second axis 132 may be substantially perpendicular to a center axis of the main body, e.g., first axis 126.

Figure 3A:
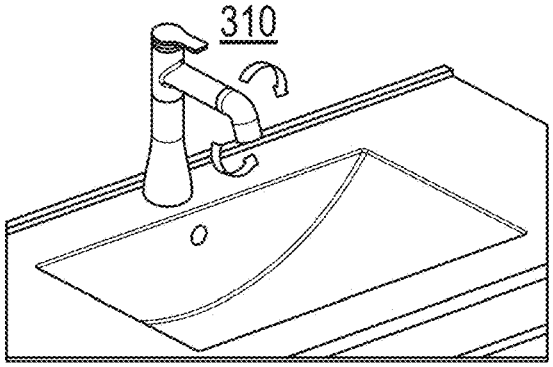
FIGS. 3A-3B are example perspective views showing operative aspects of a spout tip of a faucet with orientation-based flow rate control in accordance with various embodiments.
Figure 3B:
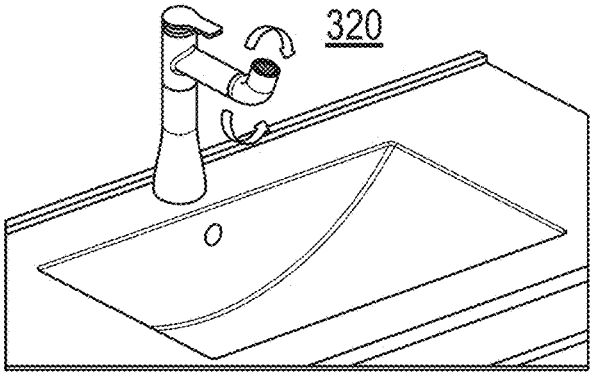
Figure 3C:
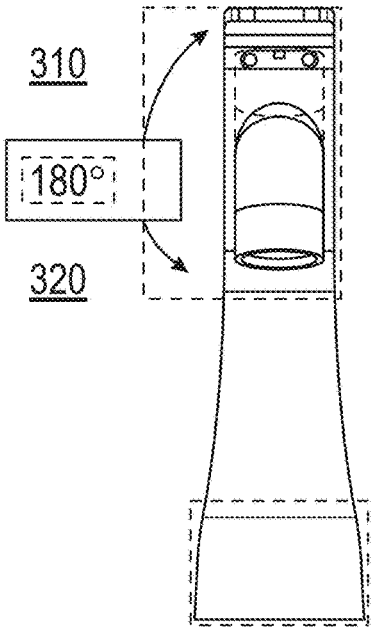
FIGS. 3C-3D are example schematic views showing operative aspects of a spout tip of a faucet with orientation-based flow rate control in accordance with various embodiments.
Figure 3D:
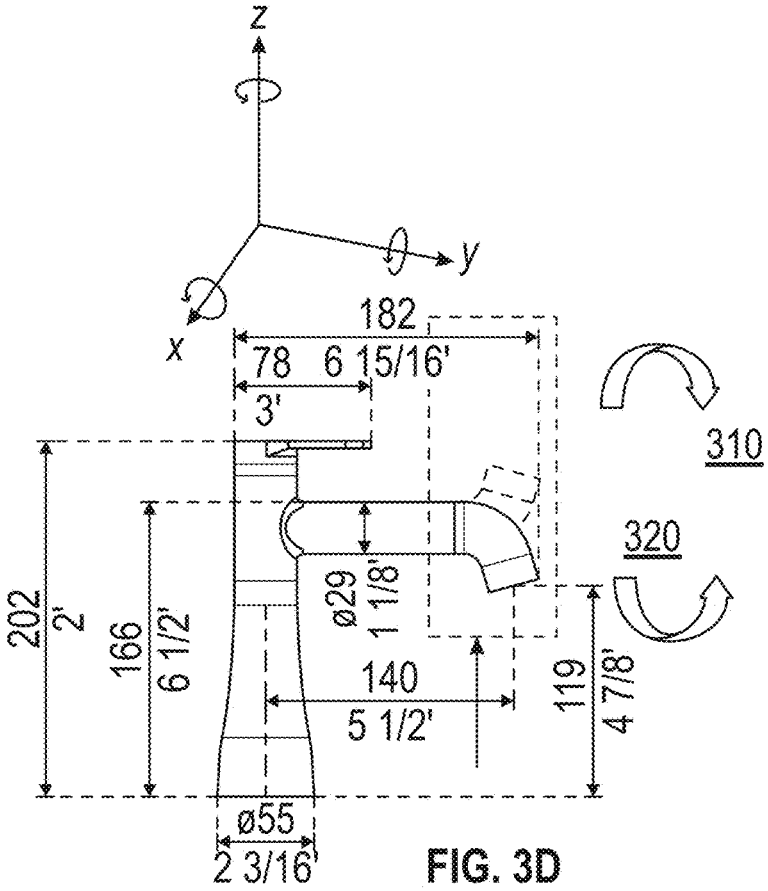

FIGS. 3A-3D are perspective and schematic views showing operative aspects of a spout tip 130 of a faucet 100 with orientation-based flow rate control in accordance with various embodiments. Referring collectively to FIGS. 1A-1B and 3A-3D, the spout tip 130 may be operative to pivot around the second axis 132, e.g., in either a first direction 310, a second direction 320, or in both the first direction 310 and the second direction 320. For example, as shown in FIG. 3C, the spout tip 130 may be operative to pivot around the second axis 132 with at least 180 degrees of freedom (i.e., at least 180 degrees in each of the first and second directions). In another example (not shown), the spout tip 130 may be operative to pivot around the second axis 132 with 360 degrees of freedom. In other words, the spout tip 130 could turn completely in either direction. For example, the degree of freedom with which the spout tip 130 is operative to pivot may be based on one or more use cases including, e.g., washing (hands or other things), drinking water, and/or cleaning a sink basin.

Again, referring back to FIGS. 1A and 1B, the flow rate controller 135 is connected to at least one of the spout 120 or spout tip 130 and operative to provide for maintaining or adjusting a flow rate of water flowing through the exit 150 in response to at least one of the spout pivoting around the first axis or the spout tip pivoting around the second axis. The flow rate controller 135 may comprise an aerator connected to the spout tip. For example, at least a portion of the aerator may be connected to an inner portion of the spout tip. In some embodiments, the flow rate controller 135 may comprise a flow rate constrictor operative to maintain the flow rate of water flowing through the exit 150 at or below a threshold (e.g., an upper limit for flow rate based on a particular use case, sink basin area, and/or other factors) in response to at least one of the spout pivoting around the first axis or the spout tip pivoting around the second axis. In other words, the flow rate controller 135 may maintain the water flow rate regardless of the movement of the spout pivoting around the first axis or the spout tip pivoting around the second axis. In some embodiments, the flow rate controller 135 may be further operative to provide for adjusting a target spray area of water exiting through the outlet. For example, the spout tip may be operative to tilt toward a desired target spray area of a sink basin, e.g., in response to a user input.

In some embodiments, the flow rate controller 135 may comprise at least one adjustable element connected to an inner portion of at least one of the spout or spout tip to provide for maintaining or adjusting the flow rate of water exiting through the outlet. For example, the adjustable element may define a cross-sectional area for allowing a flow of water through the spout tip such that the flow rate of water flowing through the exit 150 changes in accordance with a movement of the adjustable element.

In some embodiments, the flow rate controller 135 may comprise a valve connected to an inner portion of at least one of the spout or spout tip, where the valve may comprise: a first valve element movable in accordance with at least one of the spout pivoting around the first axis or the spout tip pivoting around the second axis (e.g., a change in orientation of at least one of the spout or the spout tip); and a second valve element operative to remain in a fixed position with respect to the first valve element, where the first valve element is operative to change orientation with respect to the second valve element to provide for adjusting or otherwise controlling the flow rate of water exiting through the outlet. The first valve element may be operative to rotate with respect to the second valve element to provide for an opening having a variable cross-sectional area for water flowing from the waterway.

In some embodiments, the flow rate controller 135 may comprise a control portion operably coupled to the waterway and movable from a first position for providing a first flow rate of water, to a second position for providing a second flow rate of water. For example, the second flow rate may be less than the first flow rate. The control portion may be movable to the first position for providing the first flow rate of water when the spout tip is oriented between −90 and 90 degrees with respect to a plane parallel to the main body, and to the second position for providing the second flow rate of water when the when the spout tip is oriented between −90 to −180 degrees or 90 to 180 degrees with respect to the plane parallel to the main body.

Figure 1C:
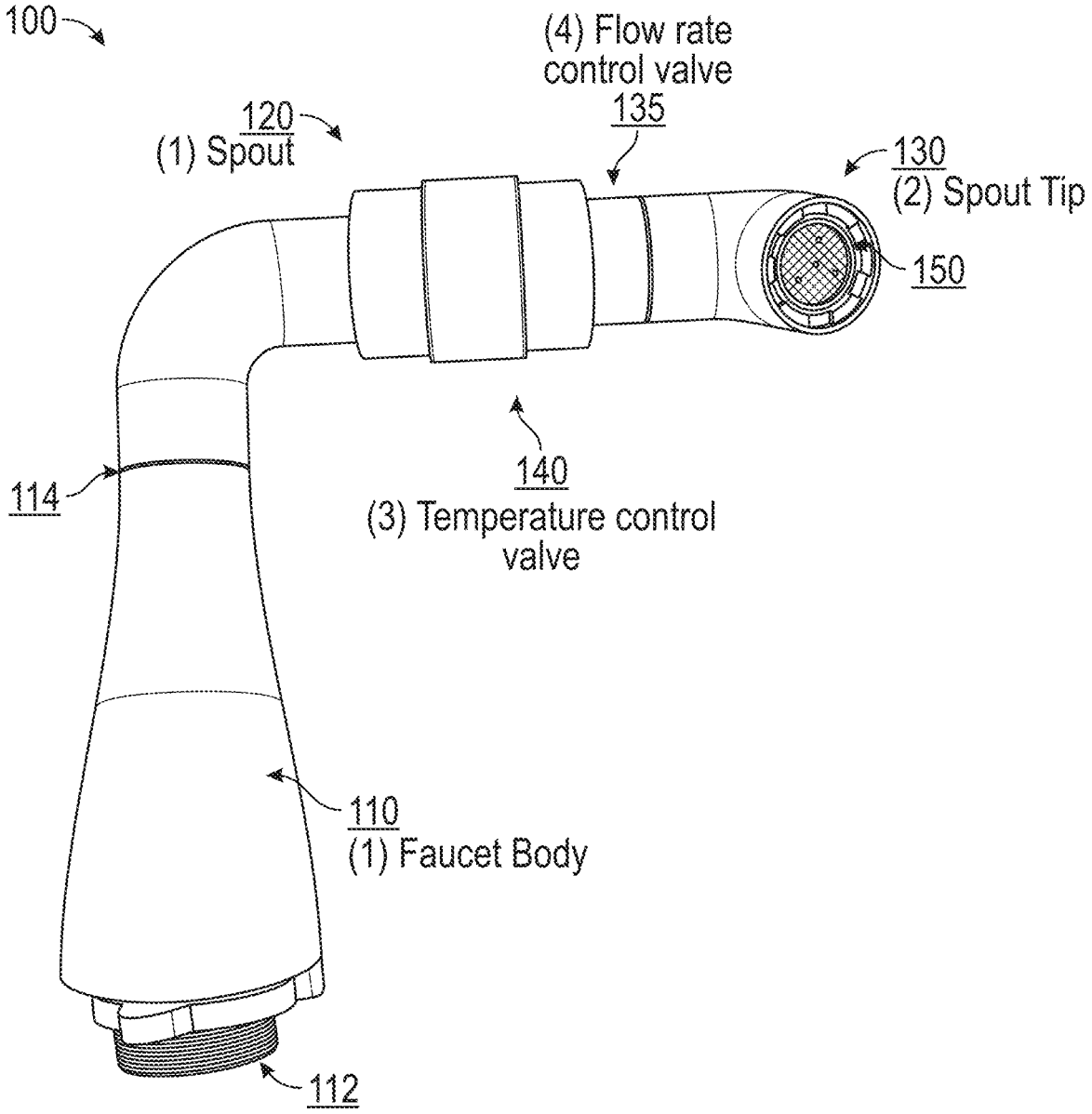
FIG. 1C is a perspective view of an alternative exemplary design for a faucet with orientation-based flow rate control in accordance with various embodiments.

FIG. 1C is a perspective view of an alternative exemplary design for a faucet with orientation-based flow rate control in accordance with various embodiments. Referring to FIG. 1C, faucet 100 may comprise a main body 110, a spout 120, a spout tip 130, a flow rate controller 135, and (optionally) a user interface (e.g., a handle) 140.

The main body 110 includes a lower inlet 112 operative to receive a waterway (i.e., a water supply) and an upper outlet 114. The main body 110 may have generally tubular housing (as shown in FIG. 1A), a box-shaped housing, or a housing of another shape. The lower inlet 112 of main body 110 may comprise a hub including a hot-water inlet conduit fluidly coupled to a hot water supply, a cold-water inlet conduit fluidly coupled to a cold-water supply. In some embodiments, the lower inlet 112 may have an increased diameter to accommodate the hub. As shown in FIG. 1C, the mixing valve may be controlled by a user interface 140 configured to be in-line or co-axial with the spout 120. In some embodiments, the user interface 140 may comprise a second flow rate controller comprising at least one of a faucet lever or spout assembly connected to at least one of the spout, the spout tip, or the main body. The second flow rate controller may be operative to provide for adjusting the flow rate of water exiting through the outlet, e.g., in response to a user input such a force exerted to move the user interface/handle from a first position to a second position. In other words, the faucet 100 may comprise a first flow rate controller and a second flow rate controller, where one flow rate controller is set initially via the user interface 140 (e.g., at an initial flow rate or a flow rate set in accordance with a typical use case), and another flow rate controller, e.g., flow rate controller 135, is set in response to an orientation of the spout 120 or spout tip 130 (e.g., in response to a change in orientation for a different use case). In some embodiments, the second flow rate controller may comprise a temperature controller operative to provide temperature control for water flowing from the waterway. Therefore, the user interface 140 may be operative to provide for adjusting or otherwise controlling the flow rate and/or the temperature of water supplied by the hot and cold-water inlet conduits to the upper outlet 114. For example, the user interface 140 may provide for flow rate and temperature control in response to a user input, e.g., twisting the user interface 140 around an axis that is co-axial with the spout 120.

The spout 120 is connected to the upper outlet 114 of main body 110 to receive water supplied by the waterway via the hot and cold-water inlets. For example, the spout 120 may include a first portion 122 movably coupled to the upper outlet 114 of the main body 110 and operative to receive water flowing from the waterway and a second portion 124 extending along a plane 125 outward from the main body 110 and operative to allow water from the waterway to flow therethrough. For example, as shown in FIG. 1C, the second portion 124 of the spout 120 may extend along a plane substantially perpendicular to the main body 110. The spout 120 is operative to pivot around a first axis 126 in response to a user input, e.g., in response to a user exerting a force on the spout 1C, the first axis 126 may be substantially co-axial with, or substantially parallel to, the main body 110.

The spout tip 130 is connected to the second portion 124 of the spout 120. The spout tip 130 provides an exit 150 for water flowing from the waterway. The spout tip 130 is operative to pivot around a second axis 125 in response to a user input, e.g., in response to a user exerting a force on the spout tip 130 that causes the spout tip 130 to pivot around the second axis 125. For example, as shown in FIG. 1C, the second axis 125 may be substantially perpendicular to a center axis of the main body, e.g., first axis 126.

Referring still to FIG. 1C, the flow rate controller 135 may be connected to at least one of the spout 120 or spout tip 130 and be operative to provide for maintaining or adjusting a flow rate of water flowing through the exit 150. In an embodiment, the flow rate controller 135 may be operative to adjust the flow rate of water in response to at least one of the spout 120 pivoting around the first axis 126 or the spout tip 130 pivoting around the second axis 125. In some embodiments, the flow rate controller 135 may be further operative to tilt, e.g., in response to a user input, to adjust a target spray area of water flowing through the exit 150.

While FIGS. 1A-3D detail a faucet 100 with orientation-based flow rate control in accordance with various embodiments for illustrative purposes, it should be appreciated that the various embodiments may find equal applicability with various fluid delivery devices, including bathroom faucets, kitchen faucets, side sprayers typically used with kitchen faucets (e.g., side sprayers having delivery spouts mounted separately from a main faucet on a countertop), etc.

Figure 4A:
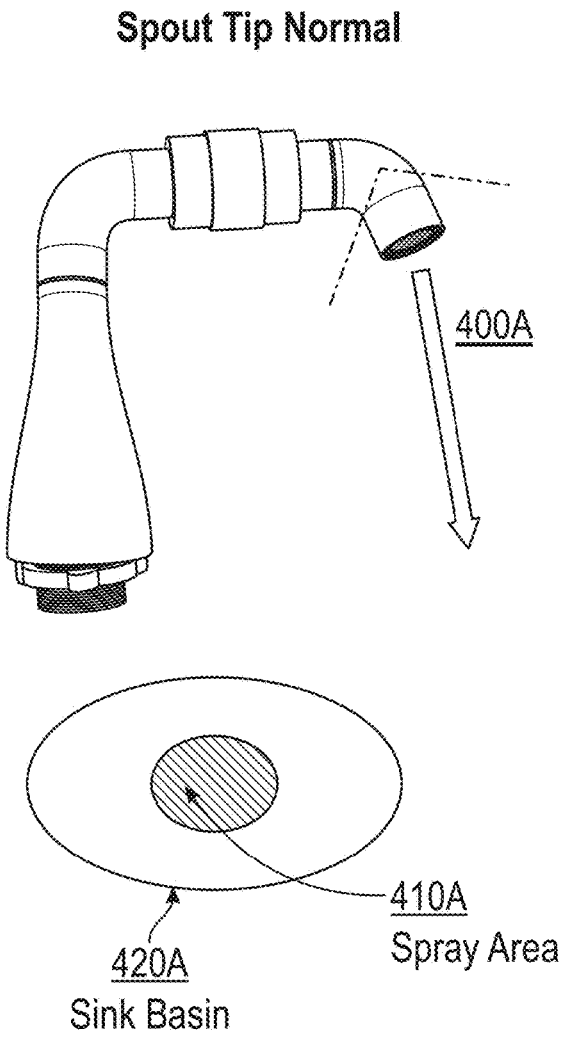
FIGS. 4A-4B illustrate example target spray areas of a faucet with orientation-based flow rate control in accordance with various embodiments.
Figure 4B:
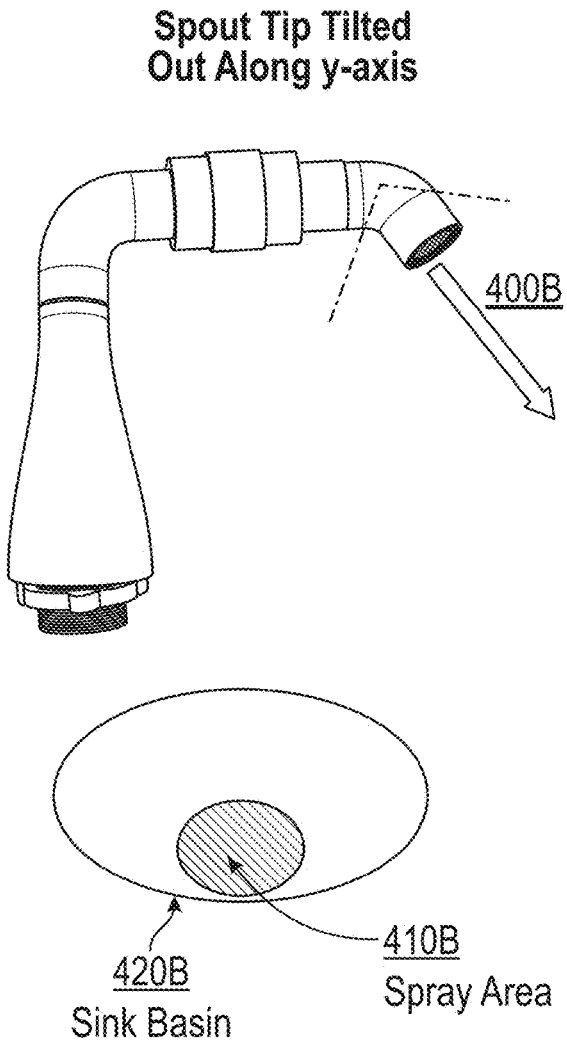

FIGS. 4A-4B illustrate example target spray areas of a faucet with orientation-based flow rate control in accordance with various embodiments. Referring to a perspective views in FIGS. 4A-4B showing operative aspects of a spout tip 130 of a faucet, e.g., a faucet 100 as illustrated in FIG. 1C, the spout tip 130 may be operative to tilt to adjust a target spray area of water flowing through the exit. For example, the spout tip 130 may be operative to tilt to provide for a first target spray area of water generally centered around a particular location within a sink basin. For example, FIG. 4A shows the spout tip 130 operative to tilt to a first position, or in a first direction 400A, to provide for a target spray area 410A of water generally centered within the sink basin 420A, e.g., a nominal target spray area optimized for washing hands within the sink basin. In FIG. 4B, the spout tip 130 is shown to be operative to tilt to a second position, or in a second direction 400B, to provide for a target spray area 410B of water centered around an edge location within the sink basin 420B, e.g., a target spray area optimized for cleaning the sink basin.

Figures 5A, 5B, 5C:
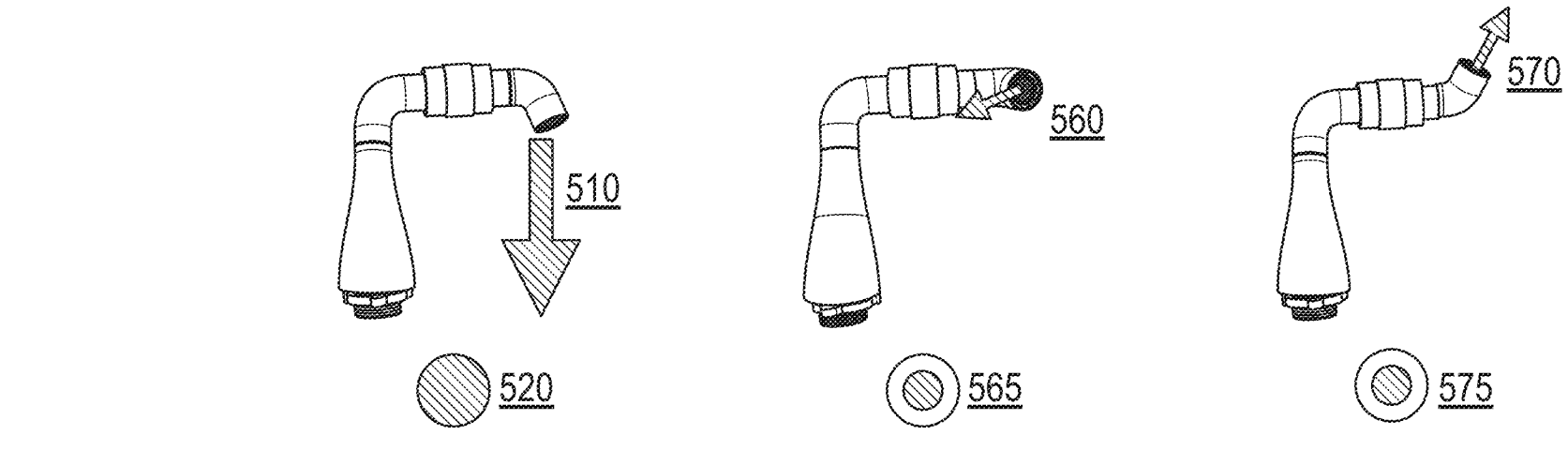
FIGS. 5A-5C illustrate example water flow rates and operations of a flow rate controller of a faucet with orientation-based flow rate control in accordance with various embodiments.

FIGS. 5A-5C illustrate example water flow rates and example operations of a flow rate controller of a faucet with orientation-based flow rate control in accordance with various embodiments. As described above with respect to FIG. 1C, the spout tip 130 may be further operative to be rotatable, e.g., with up to 360 degrees of freedom, to direct the water flowing through the exit 150 of the spout tip 130. For example, referring to FIGS. 1A-1C and FIG. 5A, a spout tip, e.g., spout tip 130, is operative to rotate to a first (nominal) position 510 to direct the water exiting the spout tip at a target spray area, e.g., a target spray area generally centered within a sink basin, at a first flow rate 520, e.g., at a flow rate and target spray area optimized for washing hands within the sink basin.

In an embodiment, the flow rate controller, e.g., flow rate controller 135, may comprise a valve connected to an inner portion of at least one of the spout or spout tip, where the valve may comprise a first valve element, e.g., a rotating front piece 530, and a second valve element, e.g., a fixed back circle 540. For example, the first valve element 530 may be movable in accordance with a change in orientation of at least one of the spout tip or spout due to a connection that provides for the first valve element 530 to be movable in accordance with the spout tip and/or spout. For example, the connection may be a direct connection (e.g., a direct interlocking mechanism or an interacting seat element and washer apparatus), an indirect connection, a mechanical connection, an electromechanical connection, or a combination of different types of connections. In some embodiments, the connection between the first valve element 530 and the spout tip and/or spout may provide for the first valve element 530 to be movable by a particular ratio in accordance with a movement of the spout tip and/or spout. For example, the ratio of movement between the spout tip and/or spout and the first valve element 530 may be 2:1, 3:1, 5:1, or another ratio, such that the taper or increase of the flow rate of water flowing through the exit is caused to be more gradual, or more rapid, than the translated movement of the spout and/or spout tip. In some embodiments, an electromechanical connection may comprise control circuitry configured or programmed to establish and/or maintain a desired ratio of movement between the spout tip and/or spout and the first valve element.

In some embodiments, the flow rate controller may comprise at least one adjustable element, e.g., first valve element 530, connected to an inner portion of at least one of the spout or spout tip to provide for maintaining and/or adjusting the flow rate of water flowing through the exit. The adjustable element may define a cross-sectional area for allowing a flow of water through the spout tip such that the flow rate of water flowing through the exit changes in accordance with a movement of the adjustable element.

In some embodiments, the flow rate controller may comprise a control portion, e.g., a valve and/or another device, operably coupled to the waterway and movable from a first position for providing a first flow rate of water, to a second position for providing a second flow rate of water, e.g., where the second flow rate may be less than the first flow rate. The control portion may be movable to the first position for providing the first flow rate of water when the spout tip is oriented between −90 and 90 degrees with respect to a plane parallel to the main body, and to the second position for providing the second flow rate of water when the when the spout tip is oriented between −90 to −180 degrees or 90 to 180 degrees with respect to the plane parallel to the main body.

Referring to FIG. 5A, the second valve element 540 may be operative to remain in a fixed position 545A with respect to the first valve element 530, where the first valve element 530 is operative to change orientation 550A with respect to the second valve element 540 to provide for controlling the flow rate of water exiting through the spout tip. In other words, the first valve element 530 may be operative to rotate 550A with respect to the fixed position 545A of the second valve element 540 to provide for an opening 555A having a variable cross-sectional area for water flowing from the waterway, i.e., an opening with a cross-sectional area that allows for water to pass through.

FIG. 5B shows the spout tip operative to rotate to a second position 560 (e.g., rotated −90 or +90 degrees from the first position) to direct the water exiting the spout tip at a target spray area at a second flow rate 565, e.g., a flow rate and target spray area optimized for cleaning the sink basin. For example, the first valve element 530 may be movable, e.g., to second position 550B, in accordance with the change in orientation of the spout tip and/or the spout. The second valve element 540 may be operative to remain in the fixed position 545B with respect to the first valve element 530, where the change in orientation of first valve element 530 with respect to the second valve element 540 is operative to provide for controlling the flow rate of water exiting through the spout tip. As shown in FIG. 5B, the first valve element 530 may be operative to rotate with respect to the second valve element 540 to provide for an opening having a second cross-sectional area 555B for water to pass through. For example, the second cross-sectional area 555B of the opening for water to pass through when the spout tip rotates to the second position 560 may be less than the first cross-sectional area 555A of the opening for water to pass through when the spout tip is in the first position. Therefore, the flow rate of water exiting through the spout tip may be lower when the spout tip is oriented in the second position 560 than when the spout tip 130 is oriented in the first position 510, as shown in FIG. 5A.

FIG. 5C shows the spout tip operative to rotate to a third position 570 (e.g., rotated −180 or +180 degrees from the first position) to direct the water exiting the spout tip at a target spray area at a third flow rate 575, e.g., at a flow rate and target spray area optimized for drinking water from the spout tip. For example, the first valve element 530 may be movable, e.g., to third position 550C, in accordance with the change in orientation of the spout tip and, optionally, the spout. The second valve element 540 may be operative to remain in the fixed position 545C with respect to the first valve element 530, where the change in orientation of first valve element 530 with respect to the second valve element 540 is operative to provide for controlling the flow rate of water exiting through the spout tip. As shown in FIG. 5C, the first valve element 530 may be operative to rotate with respect to the second valve element 540 to provide for an opening having a third cross-sectional area 555C for water to pass through. For example, the third cross-sectional area 555C of the opening for water to pass through when the spout tip rotates to the third position 570 may be less than the second cross-sectional area 555B of the opening for water to pass through when the spout tip 130 is in the second position 560 (and less than the first cross-sectional area 555A of the opening for water to pass through when the spout tip 130 is in the first position 510). Therefore, the flow rate of water exiting through the spout tip is lower when the spout tip 130 is oriented in the third position 570 than when the spout tip 130 is oriented in the second position 560 or the first position 510.

In some embodiments, the first valve element 530 and second valve element 540 may be operative to provide for maintaining a flow rate of water flowing through the exit. For example, the first valve element 530 and second valve element 540 may comprise a flow rate constrictor operative to maintain the flow rate of water flowing through the exit at or below a threshold (e.g., an upper limit for flow rate based on a particular use case, sink basin area, and/or other factors) in response to at least one of the spout pivoting around the first axis or the spout tip pivoting around the second axis. In other words, the first valve element 530 and second valve element 540 may maintain the water flow rate regardless of the movement of the spout pivoting around the first axis or the spout tip pivoting around the second axis.

Further, in some embodiments, a faucet having orientation-based flow rate control in accordance with embodiments described herein, e.g., faucet 100, may comprise a plurality of flow rate controllers. For example, at least one flow rate controller may be set via the user interface 140 to an initial flow rate or a flow rate set in accordance with a typical use case, and at least one flow rate controller, e.g., flow rate controller 135, may be set automatically in response to an orientation of the spout 120 or spout tip 130, e.g., for a different use case. Additionally, an electromechanical connection between one or more flow rate controllers and at least one of the spout or spout tip may comprise control circuitry configured to establish and/or maintain a desired flow rate, e.g., based on a ratio of movement between the spout tip and/or spout and an element of the one or more flow rate controllers. For example, the control circuitry may comprise one or more sensors to provide feedback to one or more processors to establish and/or maintain a desired flow rate.

Therefore, a faucet having orientation-based flow rate control in accordance with embodiments described herein is operative to provide a specific water flow rate and target spray area for multiple use cases including, e.g., washing (hands or other things), drinking water, and/or cleaning a sink basin.

Figure 6:
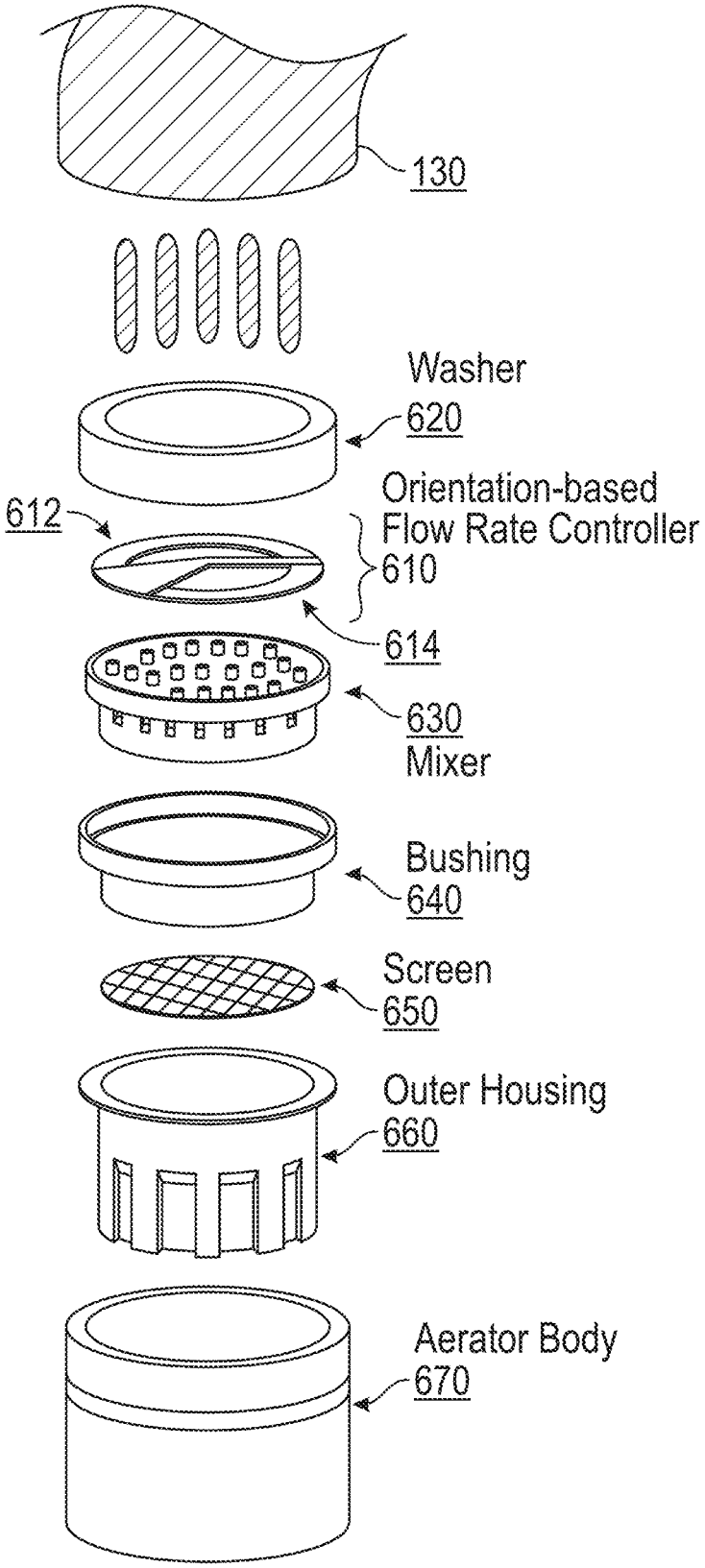
FIG. 6 illustrates a component view of an exemplary flow rate controller comprising an aerator for a faucet with orientation-based flow rate control in accordance with various embodiments.

FIG. 6 illustrates a component view of an exemplary flow rate controller comprising an aerator 600 for a faucet with orientation-based flow rate control in accordance with various embodiments. Referring to FIG. 6, the flow rate controller may comprise an aerator connected to an inner portion of the spout tip. For example, the aerator 600 may comprise a flow rate controller 610, e.g., having a first valve element 612 (e.g., a rotating front piece), and a second valve element 614 (e.g., a fixed back circle). In addition, the aerator 600 may comprise one or more of a washer 620, mixer 630, bushing 640, screen 650, outer housing 660, and aerator body 670. The aerator 600 may be connected to at least one of the spout tip (as shown) or spout of a faucet, e.g., spout tip 130 or spout 120 of faucet 100, via one or more of washer 620, outer housing 660, and/or aerator body 670 to provide orientation-based flow rate control in accordance with the embodiments herein. For example, the first valve element 612 may be connected either directly or indirectly to at least one of the spout tip or spout of the faucet such that the first valve element 612 is movable in accordance with the change in orientation of the spout tip and/or the spout, while the second valve element 614 remains in a fixed position with respect to the first valve element 612. Thus, the first valve element 612 and second valve element 614 may be operative to provide for maintaining or adjusting a flow rate of water flowing through the exit in response to at least one of the spout pivoting around the first axis or the spout tip pivoting around the second axis. In some embodiments, the flow rate controller 610, e.g., first valve element 612 and second valve element 614, may comprise a flow rate constrictor operative to maintain the flow rate of water flowing through the exit at or below a threshold in response to at least one of the spout pivoting around the first axis or the spout tip pivoting around the second axis. In other words, the flow rate controller 610 may maintain the water flow rate regardless of the movement of the spout pivoting around the first axis or the spout tip pivoting around the second axis. The mixer 630 may be operative to allow for controlling the flow of hot and cold water, e.g., based on a user input via a temperature controller, by mixing the hot and cold water together into a stream at a desired temperature. The bushing 640 may be operative to hold the mixer 630 in place with respect to the screen 650. The screen 650 may comprise a plurality of holes to add air to the water flow as it exits out of the faucet tip, which can reduce the amount of water that comes out of the faucet and be operative to control the water stream (e.g., to prevent splashing, uneven water flow, etc.). One skilled in the art will appreciate that the mixer 630, bushing 640, and screen 650 may be operative, collectively, to smooth and direct the flow rate of water exiting through the spout tip at a selected water temperature. One skilled in the art will further appreciate that other configurations of an aerator 600 comprising a flow rate controller 610 as described herein are possible and within the scope of the various embodiments herein.

Figure 7:
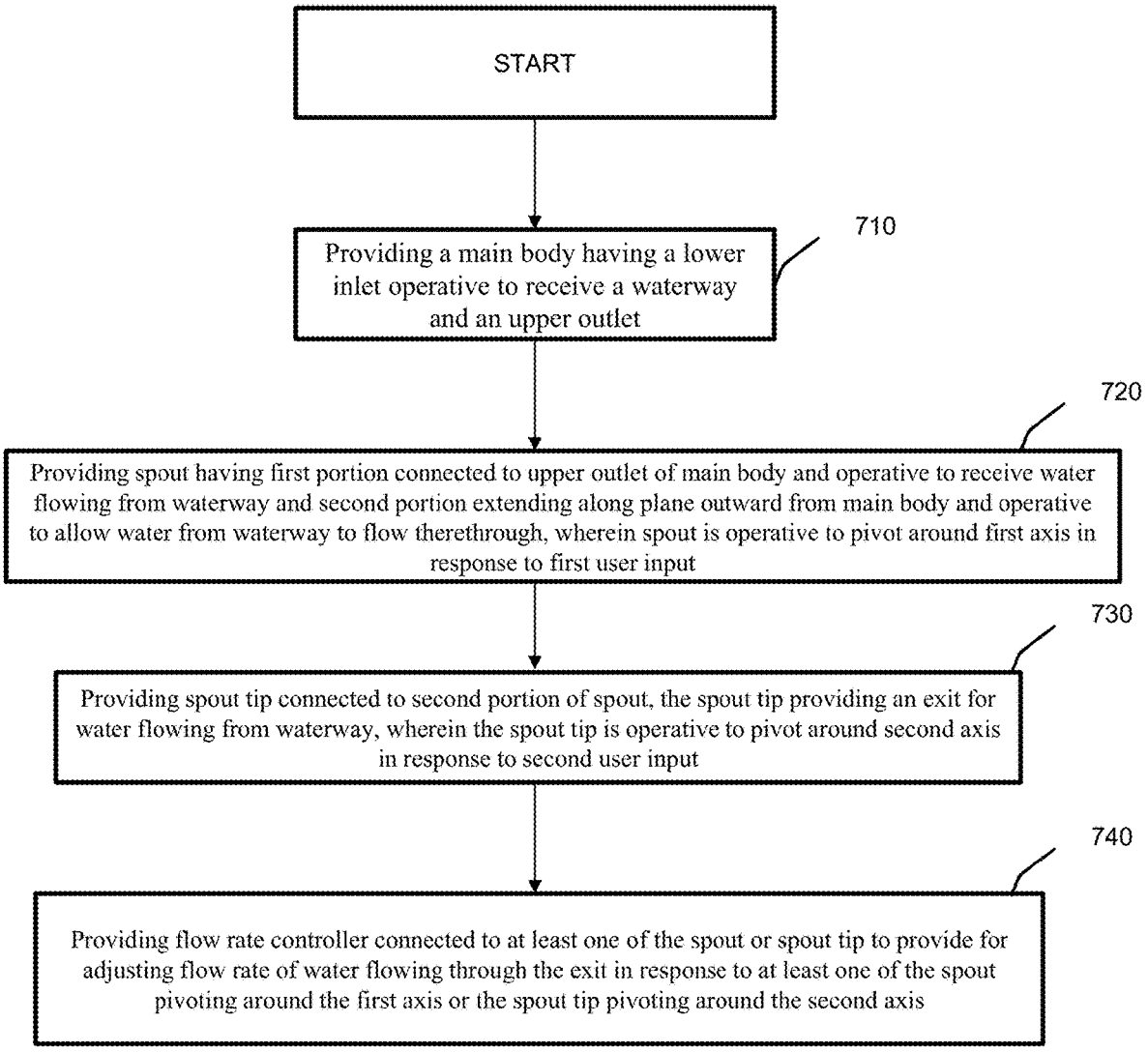
FIG. 7 is a flow diagram of a method of manufacturing a faucet with orientation-based flow rate control in accordance with various embodiments.

FIG. 7 is a flow diagram of a method 700 of manufacturing a faucet with orientation-based flow rate control in accordance with various embodiments. For example, as shown in FIGS. 1A & 1B, a faucet with orientation-based flow rate control may comprise a main body 110, a spout 120, a spout tip 130, a flow rate controller 135, and (optionally) a temperature controller 140.

At block 710, a method of manufacturing a faucet comprises providing a main body having a lower inlet operative to receive a waterway and an upper outlet.

At block 720, the method of manufacturing a faucet further comprises providing a spout having a first portion connected to the upper outlet of the main body and operative to receive water flowing from the waterway and a second portion extending along a plane outward from the main body and operative to allow water from the waterway to flow therethrough, wherein the spout is operative to pivot around a first axis in response to a first user input. For example, the first axis may be substantially co-axial with, or substantially parallel to, the main body.

At block 730 the method of manufacturing a faucet further comprises providing a spout tip connected to the second portion of the spout, the spout tip providing an exit for water flowing from the waterway, wherein the spout tip is operative to pivot around a second axis in response to a second user input. For example, the second axis may be substantially perpendicular to a center axis of the main body, and the second portion of the spout may extend along a plane substantially perpendicular to the main body.

At block 740, the method of manufacturing a faucet further comprises providing a flow rate controller connected to at least one of the spout or spout tip and operative to provide for maintaining or adjusting a flow rate of water flowing through the exit in response to at least one of the spout pivoting around the first axis or the spout tip pivoting around the second axis. For example, the flow rate controller may comprise an aerator, e.g., aerator 600, connected to an inner portion of the spout tip. Further, the flow rate controller may comprise a flow rate constrictor operative to maintain the flow rate of water flowing through the exit at or below a threshold in response to at least one of the spout pivoting around the first axis or the spout tip pivoting around the second axis. In other words, the flow rate controller may maintain the water flow rate regardless of the movement of the spout pivoting around the first axis or the spout tip pivoting around the second axis. In some embodiments, the flow rate controller may be further operative to adjust a spray area of water flowing through the exit in response to a user input.

The foregoing specification is to be understood as being in every respect illustrative and exemplary, but not restrictive, and the scope of the invention disclosed herein is not to be determined from the specification, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A faucet comprising:

a main body having a lower inlet operative to receive a waterway and an upper outlet;

a spout having a first portion connected to the upper outlet of the main body and operative to receive water flowing from the waterway and a second portion extending along a plane outward from the main body and operative to allow water from the waterway to flow therethrough, wherein the spout is operative to pivot around a first axis in response to a first user input;

a spout tip connected to the second portion of the spout, the spout tip providing an exit for water flowing from the waterway, wherein the spout tip is operative to rotate with 360 degrees of freedom around a second axis in response to a second user input; and a flow rate controller connected to at least one of the spout or spout tip and operative to provide for maintaining or adjusting a flow rate of water flowing through the exit in response to at least one of the spout pivoting around the first axis or the spout tip pivoting around the second axis.

2. The faucet of claim 1, wherein the flow rate controller comprises at least one adjustable element connected to an inner portion of at least one of the spout or spout tip to provide for adjusting the flow rate of water exiting through the outlet.

3. The faucet of claim 2, wherein the adjustable element defines a cross-sectional area for allowing a flow of water through the spout tip such that the flow rate of water flowing through the exit changes in accordance with a movement of the adjustable element.

4. The faucet of claim 1, wherein the flow rate controller comprises a valve connected to an inner portion of at least one of the spout or spout tip, wherein the valve comprises:

a first valve element movable in accordance with at least one of the spout pivoting around the first axis or the spout tip pivoting around the second axis; and a second valve element operative to remain in a fixed position with respect to the first valve element, wherein the first valve element is operative to change orientation with respect to the second valve element to provide for adjusting the flow rate of water exiting through the outlet.

5. The faucet of claim 4, wherein the first valve element is operative to rotate with respect to the second valve element to provide for an opening having a variable cross-sectional area for water flowing from the waterway.

6. The faucet of claim 1, wherein the flow rate controller comprises a control portion operably coupled to the waterway and movable from a first position for providing a first flow rate of water, to a second position for providing a second flow rate of water.

7. The faucet of claim 6, wherein the control portion is movable to the first position for providing the first flow rate of water when the spout tip is oriented between-90 and 90 degrees with respect to a plane parallel to the main body.

8. The faucet of claim 7, wherein the control portion is movable to the second position for providing the second flow rate of water when the when the spout tip is oriented between −90 to −180 degrees or 90 to 180 degrees with respect to the plane parallel to the main body.

9. The faucet of claim 6, wherein the second flow rate is less than the first flow rate.

10. The faucet of claim 1, wherein the flow rate controller comprises an aerator connected to the spout tip.

11. The faucet of claim 1, wherein second portion of the spout extends along a plane substantially perpendicular to the main body.

12. The faucet of claim 1, wherein the first axis is substantially co-axial with, or substantially parallel to, the main body.

13. The faucet of claim 1, wherein the spout is operative to pivot with at least 120 degrees of freedom around the first axis.

14. The faucet of claim 1, wherein the spout is operative to pivot with at least 180 degrees of freedom around the first axis.

15. The faucet of claim 1, wherein the second axis is substantially perpendicular to a center axis of the main body.

16. The faucet of claim 1, wherein the spout tip is operative to rotate in either a first direction or a second direction with at least 180 degrees of freedom around the second axis.

17. The faucet of claim 1, wherein the spout tip is operative to rotate in either a first direction or a second direction with 360 degrees of freedom around the second axis.

18. The faucet of claim 1, further comprising a second flow rate controller operative to provide for adjusting the flow rate of water flowing through the exit in response to a third user input.

19. The faucet of claim 18, wherein the second flow rate controller comprises a temperature controller operative to provide temperature control for water flowing from the waterway.

20. The faucet of claim 18, wherein the second flow rate controller comprises at least one of a faucet lever or spout assembly connected to at least one of the spout, the spout tip, or the main body, the faucet lever or spout assembly being operative to receive the third user input.

21. The faucet of claim 18, wherein the flow rate controller is further operative to provide for adjusting a target spray area of water flowing through the exit in response to a fourth user input.

22. The faucet of claim 1, wherein the flow rate controller comprises a flow rate constrictor operative to maintain the flow rate of water flowing through the exit at or below a threshold in response to at least one of the spout pivoting around the first axis or the spout tip pivoting around the second axis.

23. The faucet of claim 1, further comprising a mode controller operative to:

receive, at a user interface, at least one of the first user input or the second user input; and cause the second portion of the spout to pivot around the first axis in response to the first user input or the spout tip to pivot around the second axis in response to the second user input.

24. A method of manufacturing a faucet, the method comprising:

providing a main body having a lower inlet operative to receive a waterway and an upper outlet;

providing a spout having a first portion connected to the upper outlet of the main body and operative to receive water flowing from the waterway and a second portion extending along a plane outward from the main body and operative to allow water from the waterway to flow therethrough, wherein the spout is operative to pivot around a first axis in response to a first user input;

providing a spout tip connected to the second portion of the spout, the spout tip providing an exit for water flowing from the waterway, wherein the spout tip is operative to rotate with 360 degrees of freedom around a second axis in response to a second user input; and providing a flow rate controller connected to at least one of the spout or spout tip and operative to provide for adjusting a flow rate of water flowing through the exit in response to at least one of the spout pivoting around the first axis or the spout tip pivoting around the second axis.

* * * * *